US005347834A

United States Patent [19]

Ramsauer

[11] Patent Number: 5,347,834

[45] Date of Patent: Sep. 20, 1994

[54] PIVOTING LEVER CATCH SECURABLE WITH A CYLINDER LOCK DEVICE

[76] Inventor: Dieter Ramsauer, Am Neuhauskothen 20, D-5620 Velbert 11, Fed. Rep. of Germany

[21] Appl. No.: 949,497

[22] PCT Filed: Apr. 24, 1991

[86] PCT No.: PCT/EP91/00786

§ 371 Date: Oct. 26, 1992

§ 102(e) Date: Oct. 26, 1992

[87] PCT Pub. No.: WO91/17334

PCT Pub. Date: Nov. 14, 1991

[30] Foreign Application Priority Data

Apr. 27, 1990 [DE] Fed. Rep. of Germany ..... 90044756[U]

[51] Int. Cl.[5] ..... E05B 13/10

[52] U.S. Cl. ..... 70/120; 70/208; 70/210; 70/215; 70/224; 70/DIG. 63

[58] Field of Search ..... 70/210, 215, 224, 82, 70/120, 467, 484, 485, DIG. 60, DIG. 63, 337, 208, 461, 462, 489

[56] References Cited

U.S. PATENT DOCUMENTS

| | | | |
|---|---|---|---|
| 1,432,785 | 10/1922 | Re | 70/461 |
| 1,500,168 | 7/1924 | Voight | 70/DIG. 60 X |
| 1,806,031 | 5/1931 | Vignos | 70/DIG. 63 X |
| 2,784,993 | 3/1957 | Collar | 70/485 X |
| 3,633,389 | 1/1972 | Horgan | 70/120 |
| 3,834,198 | 9/1974 | Wiczer | 70/208 |
| 4,930,325 | 6/1990 | Ramsauer | 70/209 |

FOREIGN PATENT DOCUMENTS

| | | | |
|---|---|---|---|
| 0261266 | 3/1988 | European Pat. Off. . | |
| 682504 | 10/1939 | Fed. Rep. of Germany | 70/489 |
| 729425 | 12/1942 | Fed. Rep. of Germany | 70/208 |
| 3407700 | 9/1985 | Fed. Rep. of Germany . | |
| 994254 | 11/1951 | France | 70/208 |
| 7900253 | 7/1980 | Netherlands . | |
| 201839 | 2/1966 | Sweden | 70/DIG. 60 |
| 1179411 | 1/1970 | United Kingdom | 70/208 |

OTHER PUBLICATIONS

Steinbach & Vollmann—Schlösser, Verschlüsse und Beschläge für die Electronindustrie—Catalog S81 Ausgabe 1. 4. 1981.

Steinbach & Vollmann—Schlösser, Verschlüsse und Beschläge für die Electronindustrie—Liste 186S vom 1. 5. 1976.

*Primary Examiner*—Lloyd A. Gall

*Attorney, Agent, or Firm*—McAulay Fisher Nissen Goldberg & Kiel

[57] ABSTRACT

The present invention relates to a swivel lever lock which is securable by a cylinder lock device and is mountable in a thin wall, such as a sheet-metal cabinet door. The swivel lever lock includes a base plate having two projections penetrating through the door leaf. One of the projections serves for the connection of a rod drive or for an articulated shaft for a hand lever, which can be swiveled away. The projection can be used simultaneously for fastening one end of the base plate. The other projection has a recess for receiving the cylinder lock device holding the swivel lever in its swiveled-in position and can be used simultaneously for fastening the other end of the base plate. Either the base plate or the swivel lever has a recess for receiving a second cylinder lock which can be actuated independently of the first cylinder lock for securing the swivel lever in its swiveled-in position. The tappets of the two locking cylinders respectively act on a common locking element in such a way that the locking element can be released from the position in which the swivel lever is locked in its swiveled-in position by one of the two cylinder locks.

19 Claims, 5 Drawing Sheets

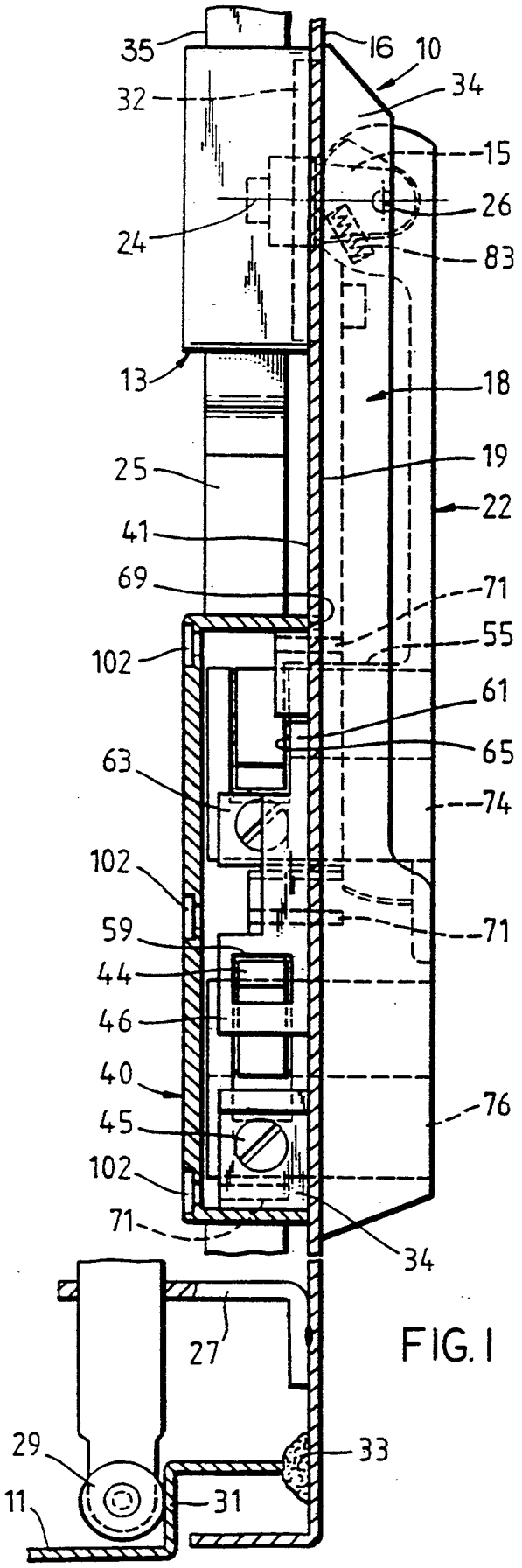
FIG. 1
FIG. 2
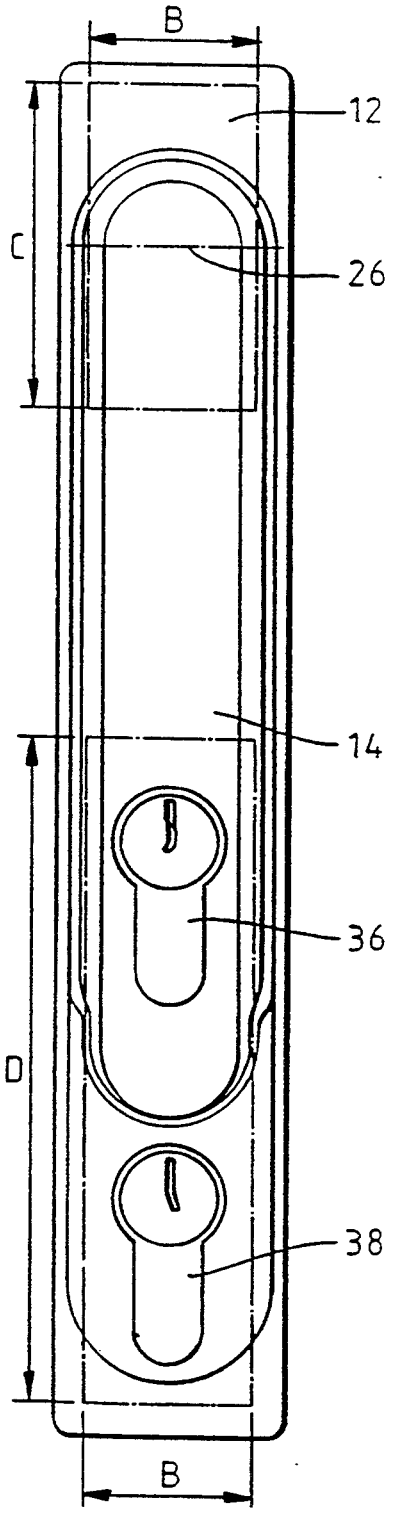

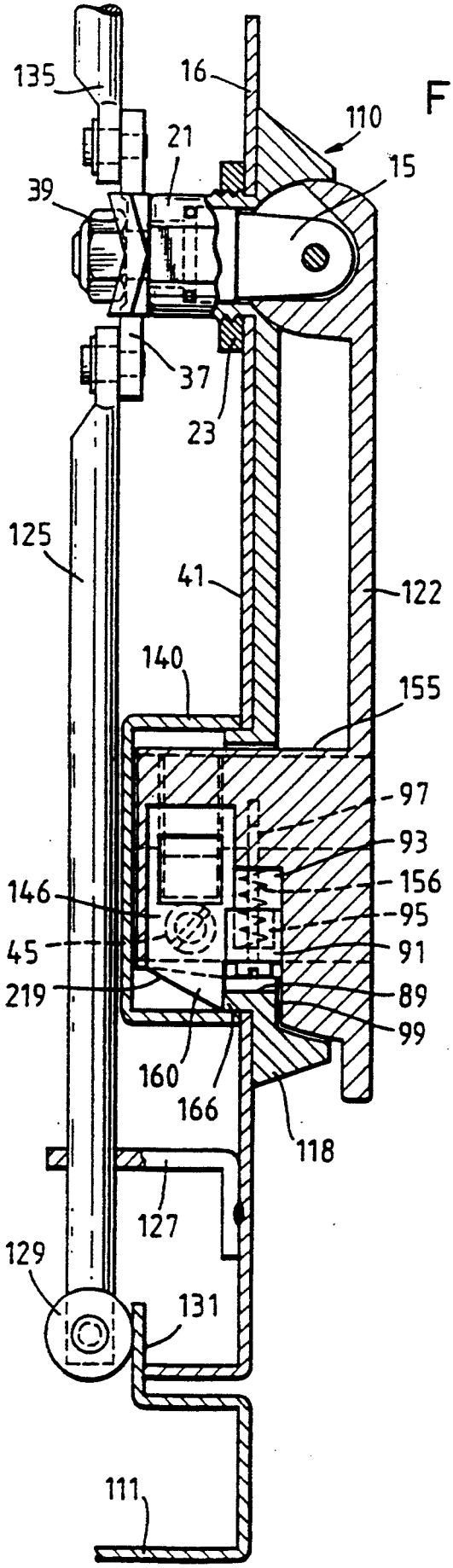
FIG. 5
FIG. 6
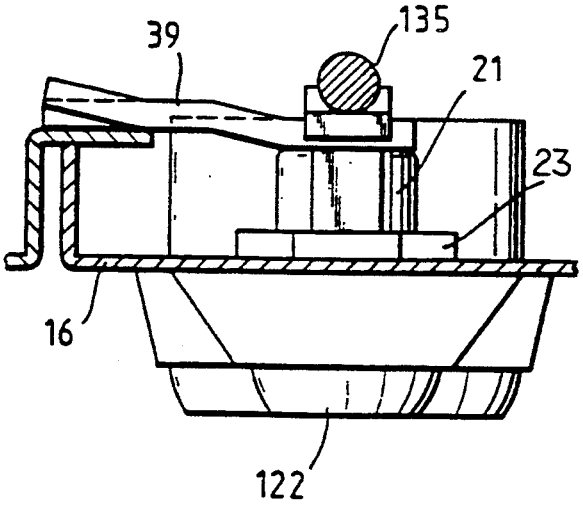

PIVOTING LEVER CATCH SECURABLE WITH A CYLINDER LOCK DEVICE

BACKGROUND OF THE INVENTION

1. Field of the Invention

The invention is directed to a locking handle. More specifically, the invention is directed to a swivel lever lock which is securable by means of a cylinder lock device.

2. Description of the Related Art

A swivel lever lock having a single lock cylinder is known from the EP 0261266A1 by the present Applicant. In this publication, there is a cylinder lock arranged in the free end of the swivel lever.

DE 3407700A1 shows a similar construction in which, however, the cylinder which locks the swivel lever in its closed position is arranged not in the swivel lever itself, but in the base plate. In contrast, the construction according to EP 0261266A1 has the advantage of a shorter overall length, since a portion of the length of the swivel lever can be used to accommodate the cylinder securing the swivel lever. A disadvantage consists in that the swivel lever is accordingly heavier and somewhat less convenient.

On the other hand, the device in DE 3407700A1 has an overall length which is greater, the swivel lever is somewhat more slender and has less weight and can accordingly be operated somewhat more easily.

Each of the two known devices is provided with only one cylinder lock.

In certain applications, for example, switch cabinets which must be monitored by both an electric utility company and customers of this electric utility company, it is advantageous or even necessary to lock the lock with two different cylinder locks. A lock which can be operated by two different cylinder keys is known from a catalog of the firm Steinbach & Vollmann. This lock can be a rod lock for two profile cylinders which can be locked by one or two cylinders in an optional manner. Similarly, this catalog also shows a bolt lock and the mortise lock No. 651/2 E748 which is also provided with an emergency unlocking device for high-voltage installations and can be mounted in steel doors. The lock can be locked optionally by one or two cylinders. One cylinder is provided for the owner of the switching installation and one cylinder is provided for the power supply utility company.

However, these locks, known from the Steinbach & Vollmann catalog, which work with two profile cylinders are not suitable for swivel lever applications, since their construction is much too bulky. It is unknown, however, how to provide a swivel lever lock having two cylinders.

SUMMARY OF THE INVENTION

The object of the invention is to provide a swivel lever lock which is outfitted with two cylinders, each cylinder allowing the lock to be unlocked and locked again independently of the other cylinder.

The object is met in that either the base plate or the swivel lever has a recess for receiving a second cylinder lock which can be actuated independently of the first cylinder lock for securing the swivel lever in its closed position, and in that the tappets of the two cylinder locks respectively engage in a common locking strip or tongue which secures the swivel lever in its closed position and can slide this locking strip or tongue out of (or, if necessary, also into) its securing position against pretensioning force (e.g. spring force) independent from one another.

A very compact construction which can be conceived in different embodiment forms is made possible in that the two tappets act on a common locking strip (locking element). Thus, the locking strip or tongue or slide in order to lock the swivel lever could be placed behind a projection or edge formed by the base plate. Alternatively, the wall in which the lock is installed could naturally also serve as a contact surface, but such an embodiment form is usually less favorable because of the careful machining of the openings in this wall which it necessitates.

A particularly favorable embodiment form is characterized in that the two cylinders are carried one after the other, but particularly in an alternative manner so as to be adjacent to one another, at the end of the swivel lever with reference to the longitudinal axis of the swivel lever.

Alternatively, the two cylinders can also be arranged axially one after the other (with reference to the longitudinal axis of the base plate) or also adjacent to one another in the base plate outside (particularly below) the trough arranged for the swivel lever stop.

More than two cylinders can also be provided when the cylinders are arranged axially one after the other with reference to the axis of the swivel lever or base plate. In this case, it is also possible to move the locking strip or tongue out of the position in which the swivel lever is locked in its closed position by means of corresponding freewheel devices. However, an embodiment form in which a cylinder is carried in the free end of the swivel lever and an additional cylinder is carried adjacent to the latter in the base plate has proven particularly advantageous. One of the two cylinders can displace a locking strip into a first position in which the tappet of the other cylinder can lock in this locking strip and into a second position in which the tappet of the other cylinder does not achieve this position.

According to another embodiment form, the locking device is designed in such a way that the locking strip or tongue is slid out of its locking position automatically when the swivel lever swivels into the base plate and the locking strip or tongue can slide back into its locking position when the fully closed position is reached.

According to another embodiment form, the projection which is provided in the region of the locking devices can carry a cap attachment which encloses the portion of the base plate and swivel lever reaching through the wall. With its edge, the cap attachment can contact the edge surfaces of the opening in the thin wall provided for the projection and accordingly clamp the wall between itself and the base plate, which performs a fastening function on the one hand and provides a seal on the other hand, particularly when the cap attachment forms a sealing lip at its edge or cooperates with a separate seal. The above-mentioned projection can also have threaded bore holes for receiving fastening screws which fix the base plate at the thin wall, particularly in such a way that they press a cap against the thin wall.

The openings can be round as in one of the examples of the prior art or rectangular as in the other example. In particular, the openings can have the same width, but a different length. In particular, the rectangular opening provided for the actuating shaft can have a length amounting to only a half or a third of the corresponding longitudinal extension of the other opening.

It has proven advisable that the length of the opening for the drive shaft be approximately twice as great as its width.

The swivel lever lock can be designed in such a way that it can be arranged in the fold space of a sheet-metal cabinet door, wherein one projection is part of a lock case in which flat rods of a rod lock are driven and supported, and/or from which a sash lock proceeds.

BRIEF DESCRIPTION OF THE DRAWINGS

The invention is explained in more detail in the following with reference to embodiment examples shown in the drawings:

FIG. 1 shows a side view, partly in section, of an embodiment form of a swivel lever lock in which a cylinder securing the swivel lever in its closed position is arranged in the free end of the swivel lever, while the second cylinder is arranged adjacent to the latter in the base plate;

FIG. 2 shows a front view of the embodiment form of FIG. 1;

FIG. 5 shows a side view of the lock according to FIG. 4, partly in section, including additional details with respect to its installation in a sheet-metal cabinet door; and FIG. 6 shows a view from the top of the lock of FIG. 4.

DESCRIPTION OF THE PREFERRED EMBODIMENTS

Figure 3:
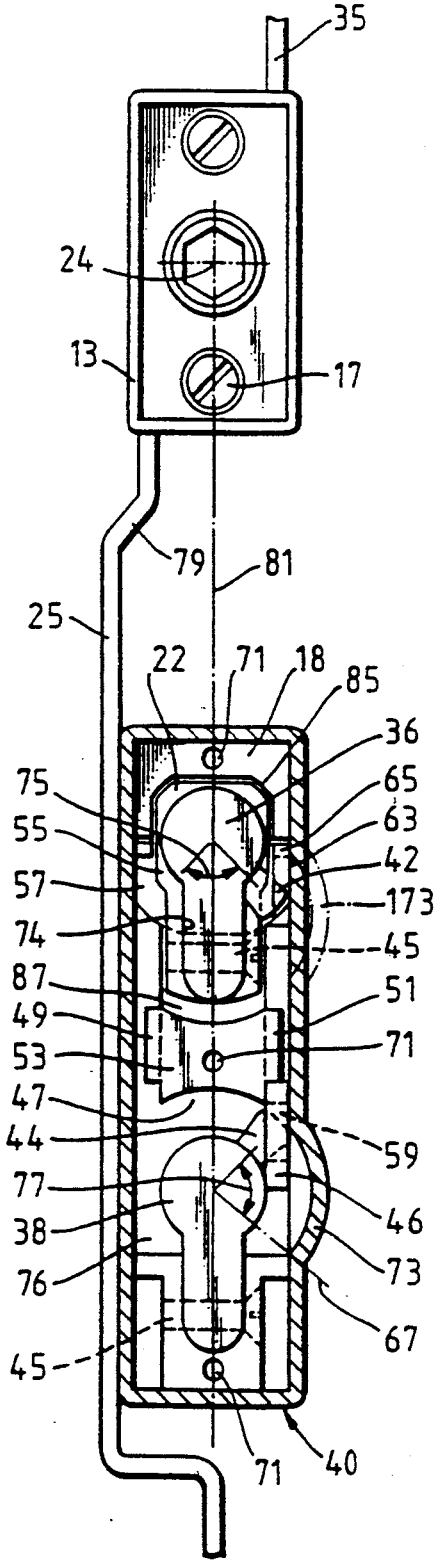
FIG. 3 shows a rear view of the embodiment form according to FIGS. 1 and 2, partly in section.

FIGS. 1 through 3 illustrate a swivel lever lock 10 which is to be arranged in a thin wall 16, in this instance a door leaf, which is mounted on a switch cabinet housing 11. The swivel lever lock includes a base plate 18 and has two projections 32 and 34 penetrating the door leaf 16 at rectangular openings 12, 14. These projections 32, 34 fix the base plate in the openings 12, 14 so as to be centered. One projection 32 serves for the connection of a rod drive 13 or at least for supporting a drive shaft 15. A swivelable hand lever (also referred to, for the sake of brevity, as a swivel lever) being mounted at this shaft 15 so as to be swivelable around axis 26, and extending vertically relative to the drive shaft axis 24. Two threaded pocket bore holes are provided in the region of the projection 32 for screws 17 which can be screwed into these pocket bore holes to press the box-shaped rod drive 13 which receives the projection 32, against the contact surface 19 of the base plate 18. In turn, the door leaf 16 is clamped between this surface 19 and the edge of the rod drive 13 enclosing the projection 32 and accordingly affixing the swivel lever lock in the door leaf at its upper end with reference to FIG. 1.

Figure 4:
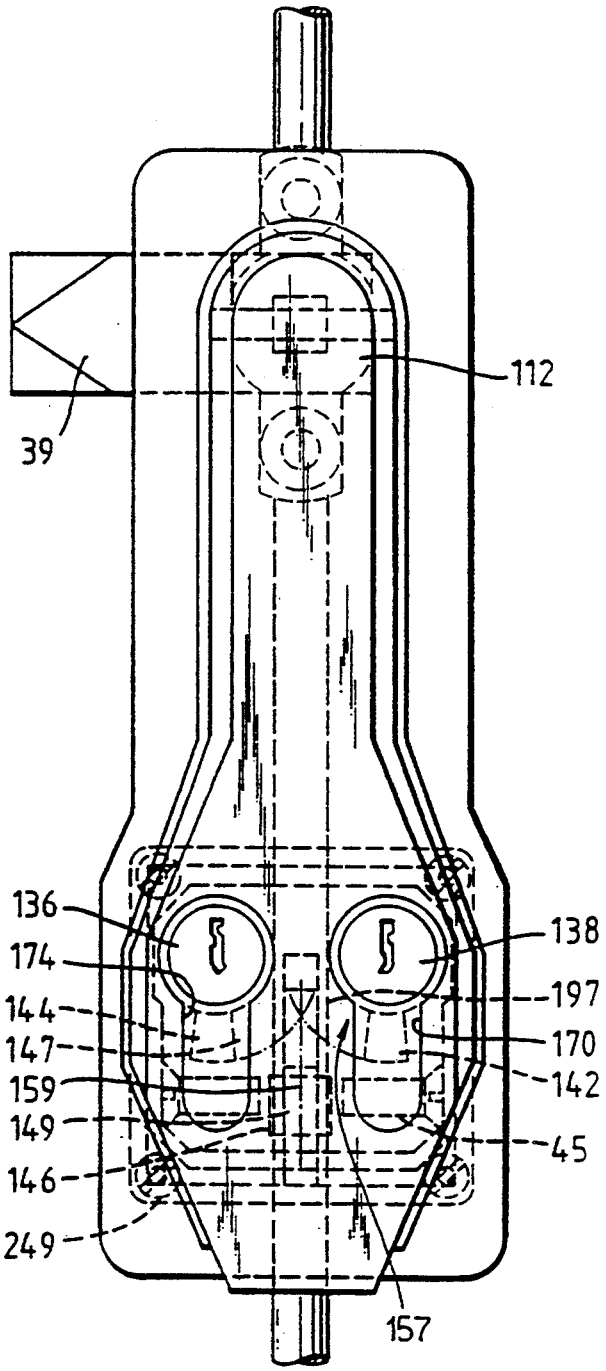
FIG. 4 shows a front view of a swivel lever lock in which two cylinders are arranged adjacent to one another at the free end of the swivel lever and actuate a common lock strip which is capable of locking the swivel lever in its swiveled in position inside the base plate.
Figure 7:
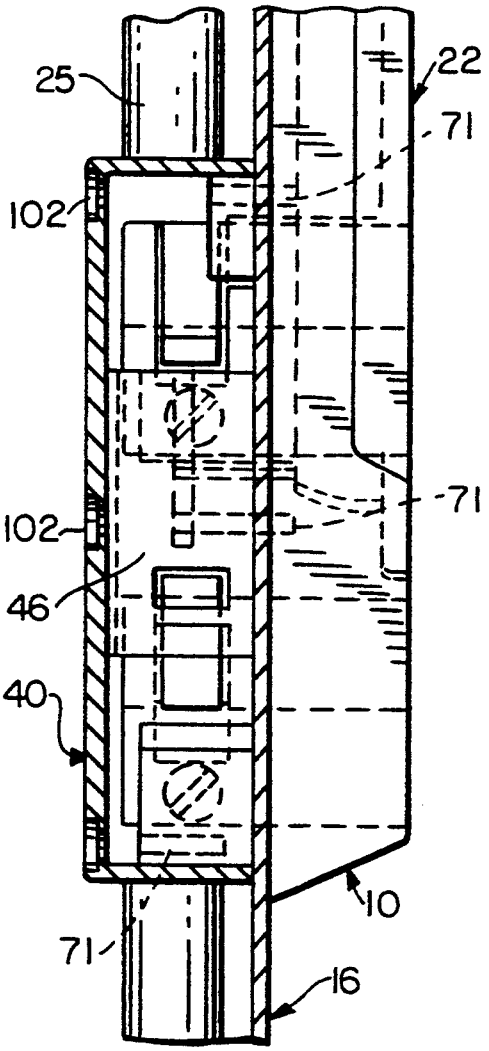
FIG. 7 is a view similar to FIG. 1, illustrating an alternate embodiment of the invention.
Figure 8:
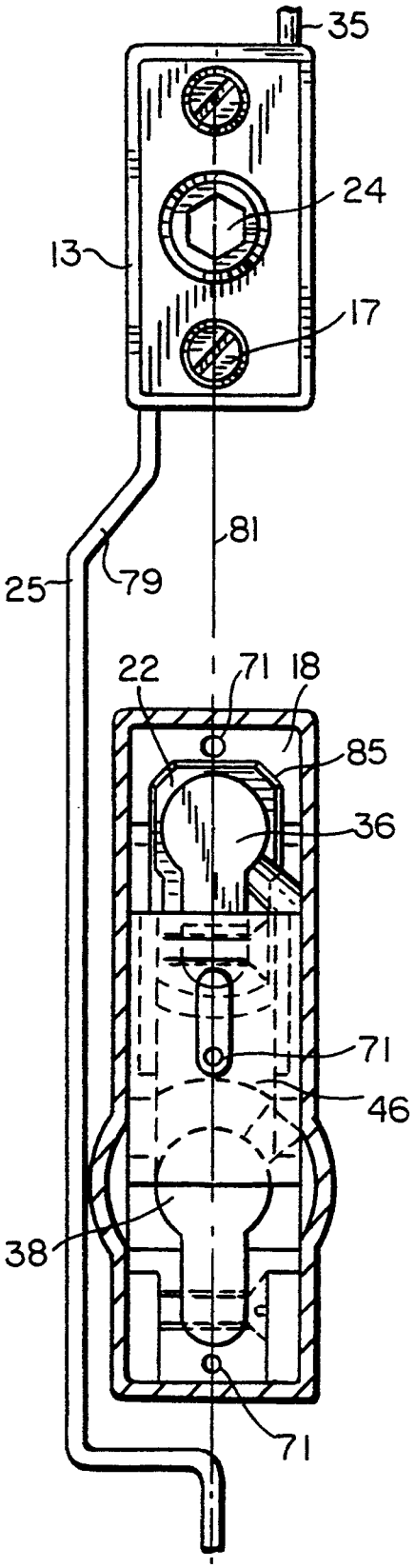
FIG. 8 is a view similar to FIG. 3, illustrating the embodiment of FIG. 8.
Figure 9:
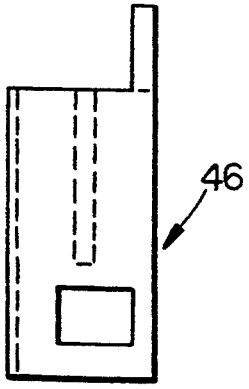
FIG. 9 illustrates a side view of the locking element of the embodiment of FIG. 8.
Figure 10:
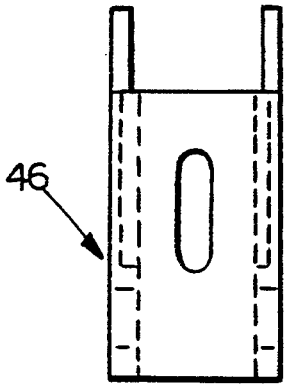
FIG. 10 is a top view of the locking element of the FIG. 10.
Figure 11:
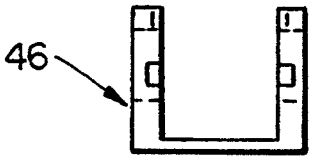
FIG. 11 is an end view of the locking element of FIG. 10.

Alternatively (see the embodiment form of FIGS. 4 to 6, the opening 112 provided for the drive shaft 15 can also be circular to receive a bearing housing 21 for the shaft 15. The bearing housing can have a circumferential thread so that this bearing housing can be fastened in the door leaf 16 by means of a union nut 23.

Referring to the embodiments of FIGS. 1 through 3, the box-shaped rod drive 13 serves for the displacement of flat ribbon rods 25, 35. In the embodiment form shown here, flat ribbon rod 25 extends to the lower end of the door leaf, ribbon rod 25 is guided in a rod guide 27 which positions the end of ribbon rod 25, behind a bevel 31 when locked. The end of ribbon rod 25 may carry a stop wheel 29. The door leaf 16 accordingly presses against the door frame edge of the switch cabinet 11 at this lower end (possibly accompanied by the clamping of a seal strip 33) and is locked. In a corresponding manner, an additional adjacent rod 35 running in the opposite direction runs to the upper end of the door leaf and causes the door to be locked in this location in an analogous manner.

In the embodiment form according to FIGS. 4 to 6, the swivel lever lock 110 shown in these figures likewise serves to actuate a rod lock of a switch cabinet door. However, this lock has round rods 125, 135 which are actuated in a manner known per se by a two-armed lever 37 which is fixed on the drive shaft 15. The ends of the round rods 125, 135 being rotatably connected to the free ends of the lever 37 in a manner known per se. Moreover, in this instance the shaft 15 carries a sash 39 which connects the door leaf approximately in the center of the cabinet with the edge of the door frame or the switch cabinet housing so as to lock. The arrangement of these rods has been described in order to show that the arrangement of such rods is not impeded despite the portions of the swivel lever lock extending through the door leaf. Thus, in the embodiment form according to FIGS. 4 and 5, the distance between the rods 125 and the inner surface 41 is large enough so that all parts of the swivel lever lock passing inward through the door leaf can be accommodated in this area. In the flat ribbon rod lock according to FIGS. 1 to 3, a corresponding bend of the flat ribbon rod 79 likewise prevents the part of the swivel lever lock penetrating the door leaf from presenting a hindrance.

In particular, the lock, as shown in FIGS. 1 to 3, can also be accommodated in the fold space of the door leaf of a switch cabinet. This space is a dead space which can normally not be utilized, but in this instance provides an ideal accommodation for a rod lock. The narrow spatial conditions brought about by this nevertheless enable the embodiment forms shown in FIGS. 1 to 3.

Details of the swivel lever lock shown in FIGS. 1 to 3 will now be discussed in the following.

The lower projection 34 of the base plate 18 forms a first insertion space 76 for a cylinder lock 38 which is fastened in the base plate 18 in a conventional manner by a fastening screw 45 extending transversely relative to this insertion space. In order to allow freedom of movement of the tappet 44 of the lock cylinder 38, the base plate is recessed in the movement region of the tappet 44 and accordingly forms a corresponding annular space 47. Guide channel 49 and 51 access this annular space 47, one channel on each side, and extends from this annular space 47 past a material web 53 into a free space which is part of the receiving space 57 and reaches up to a projection 55 carried by the end of the swivel handle. Projection 55 in turn forms a receiving space 74 for receiving at least the sides of the cylinder 36 and enables the latter to be fixed in the projection 55 carried by the end of the swivel handle by means of a fastening screw 45.

As can be seen, the arrangement is axially symmetrical to a great extent and a slide or a locking strip 46 is arranged in guide channel 51. A slide can also be optionally arranged in the guide channel 49 so as to slide along the channel axis. This strip 46 has a window-like opening 59 with a width which makes it possible to receive the tappet 44. The length of the window 59 makes it possible to receive the tappet 44 also in the longitudinal direction and also enables an axial displacement within this guide channel under the action of this tappet with the least possible play. This slide or locking strip 46 reaches into the receiving space 57 for the projection 55 carrying the cylinder 36 with its end 61 remote of the window 59. The end 61 has a window-like opening or only an offset 63 having a length such that the swiveling movement of the tappet 42 of the cylinder 36 enabled under all other conditions is not impeded in any position of the slide caused by a tappet 44.

As a result of this window or offset 63, a surface 65 is formed which extends along the tappet movement and prevents the hand lever 22 from swiveling out when the tappet 42 is located within this window or offset space 63. This is the case when the cylinder 38 has pushed the slide 46 into the locking position at the top, which is effected in the embodiment form shown here in that the tappet 44 is rotated by 90° into the position shown in the drawing from the position designated by reference number 67. That is, the slide or locking strip 46 is pushed up until the end 61 arrives in the region of the tappet 42 located in the shown position. On the other hand, when the tappet 44 is rotated back into position 67, the locking strip 46 is moved downward until the end 65 moves out of the region of the tappet 42 so that the latter is no longer impeded by the strip 46.

This means that the swivel lever can be released by means of a cylinder 38 when the cylinder 36 has its tappet 42 in the shown position.

Now the cylinder 36 can likewise be actuated by means of a key and the tappet 42 can be swiveled, e.g. particularly in such a way that it is swiveled downward by 45° (it then disappears in the cylinder) or rotated in the clockwise direction by 90° so that it arrives in the region of the guide channel 49. However, no locking strip 46 according to the drawing is arranged in this region. The swivel lever 22 can then be swiveled out in spite of the fact that the cylinder 38 is in the locking position.

Accordingly, exactly the desired function is achieved: the swivel lever 22 can be released from the base plate 18 either when the cylinder 38 is brought into the corresponding unlocking position 67 or in that the cylinder 36 is brought into a corresponding unlocking position. An actuation of the other respective cylinder is not required.

The parts penetrating the door leaf 16 and the base plate 18 as well as the swivel lever projection 55 are enclosed, according to the drawing, by a cover cap 40 which is supported by its edge surface 69 on the inner surface 41 of the door leaf 16 and in so doing encloses the projection 34 of the base plate 18 on all sides. The cover cad 40 is fixed by means of self-tapping screws (not shown) which are screwed into blind holes 71 located in portions of the base plate 18, this being effected in such a way that the door plate 16 is clamped in between the contact surface of the base plate on the one hand and the edge 69 of the cover cap on the other hand also at the lower end of the base plate (in a similar manner to that effected at the upper end by means of screws 17) and the entire arrangement is accordingly fixed.

The cover cap 40 is kept narrow enough so that it can simultaneously form a lateral boundary of the two guide channels 49, but must have a bulge 73 at least at one location so as to provide the tappet 44 with complete freedom of movement also in the direction of the wall of the cap 40. If a symmetrical arrangement is desired such bulges can be provided at all four possible locations, but a single location is usually sufficient since the tappets 44 and 42 are adjusted and can be operated by the key in such a way that such a bulge is not required for the tappet 42 of the cylinder 36, e.g. this tappet moves at most around the angle indicated by reference number 75 and the other tappet moves at most around the angle designated by reference number 77 and requires the bulge 73.

Since a bulge 73 which enlarges the width is present only at one side of the cap 40, a relatively small bend 79 is sufficient for guiding the flat ribbon rod 25 past the cap 40, which flat ribbon rod 25 is guided through the drive housing 13 to its drive and is therefore at a determined distance from the axial line 81. A somewhat greater distance from the center line than is the case with the drive box is necessary for this. The rod can then be bent again behind the cap 40 into the axial line 81.

If the type of door fastening is to be changed, e.g. from the right-hand to the left-hand side, or the rotational direction of the drive for the rods 25, 35 is to be changed, the arrangement known from EP 0261266A1 can be used, in which case the rod 25 would reach to the other side of the cap 40. However, in this case, it would be possible by means of moving the slide 46 from the shown position in the channel 51 into the other channel 49 while changing the position of the tappets 44 and 42 of the cylinders 38, 36 in a corresponding manner. Now, however, another cap is necessary which must have the bulge 73 for the tappet 44 on the left side (as seen according to FIG. 3) instead of on the right side. In order to avoid having to stock two types of cap, a second bulge 173 could be provided in an axially symmetrical manner at the right-hand side of the housing 40 shown in FIG. 3 (in dashed lines). However, this second bulge 173 is not intended for the tappet 42, but for the tappet 44 when the housing 40 is rotated by 180° so that the bulge 173 then reaches the lower left-hand side of the arrangement. The entire right-hand side of the arrangement would then be free of bulges and the rod 25 could be guided past more closely at the right side. (As can be seen, the bulge 173 is not suitable as a free space in the case of an axially symmetrical construction with reference to the bulge 73, but naturally could be extended far enough so that the tappet 42 could also move freely from the corresponding wall of the cap 40 if this should be advisable for some reason).

If the operator possessing the key for the cylinder 36 wishes to actuate the swivel handle lock, he can easily pull out the swivel lever by means of the key inserted in the cylinder 36 after the tappet 42 has swiveled into a position which no longer secures the swivel lever, even when the swivel lever 22 is enclosed in a type of trough formed by the base plate as shown. For the operator in possession of the key for the cylinder 38 (that is, the cylinder arranged in the base plate), this possibility does not exist and it can be relatively cumbersome to grasp the hand lever 22 and swivel it out after unlocking the arrangement by means of the cylinder 38. For this reason, a spring 83 is provided in the region of the axis 26 of the hand lever 22 at the actuating shaft 15. This spring 83 exerts a force on the hand lever directed in the opening direction and allows the hand lever to be opened slightly automatically as soon as the lock is disengaged. This is particularly true in the event that the unlocking is effected by means of the cylinder 38 so that it is not necessary to pull out the hand lever 22 with the tips of the fingers in a cumbersome manner.

It is noted in addition that the receiving space 57 allows the swivel lever 22 to be opened in every position defined by the angle 75 for the tappet 42, i.e. this space 57 continues up to the front surface of the base plate. The gap 85 formed between the base plate 18 and the hand lever projection 55 on the one side or area 87 on the other side is outfitted with just enough play so that the opening is not impeded. On the other hand, no unnecessary wobbling movement results in the closed state.

The size of the openings 12 and 14, respectively, necessary for the embodiment form shown in the drawing is selected in such a way that e.g. the opening 12 is the conventional opening also used in previous locks working with flat ribbon rods. It has a longitudinal extension C equal to twice the transverse extension (B), i.e. B=2C. The opening 14 for the lock device having two cylinders likewise has a transverse extension B, while the longitudinal extension D=2C=4B.

These even-numbered ratios have advantages in technical respects related to manufacture.

The additional embodiment form as shown in FIGS. 4 to 6 carries two cylinder locks 136, 138 adjacent to one another, located in the free end of the swivel lever. These cylinder locks 136, 138 are inserted in turn into corresponding insertion openings 174, 170 and fastened by means of transversely extending fastening screws 45, the cylinders being extensively enclosed by material in this case. Partial annular spaces 147 and 197, respectively, are provided and extend in such a way that the tappet 142 of the lock 138 or the tappet 144 of the lock 136 can move out of the downwardly directed position into the position directed toward the center by precisely 90°. Spaces 197 and 147 intersect at the swivel lever axis and are simultaneously penetrated at this location by a guide channel 149 in which a locking strip 146 can be displaced in a reciprocating manner. As is the case in the embodiment form already shown, the locking strip 146 has a window 159 in which, if the cylinder lock 138 is actuated, the tappet 142 engages or, if the cylinder lock 136 is actuated, the tappet 144 engages during its respective swiveling movement toward the center and in so doing displaces the slide 146 upward from the locking position shown in the drawing. While in the locking position, protuberance 160 of the slide 146 engages a stop face 166 formed by the lever base plate 118. To effect unlocking, tappet 142 or 144 enters window 159 to engage and slide strip 146 upward against the force of a pressure spring 156, into a release position in which the protuberance 160 is released with respect to the stop face 166. As a result, projection 155, and accordingly the hand lever 122, swivels out of the opening 89 formed by the base plate 118. A cover cap 140 is also provided here. This cover cap 140 can be connected by means of four fastening screws 249 with the base plate so that the door leaf plate 16 is in turn clamped between the base plate and the edge of the cover cap 140 and accordingly fixes the swivel lever lock at this lower end.

In the embodiment form shown here, the displacement strip 146 has a projection 91 which serves to guide it, which projection 91 is displaceable so as to slide in a reciprocating manner in a corresponding guide groove in the hand lever 122, see reference number 93, and in addition has a recess region 95 in which the pressure spring 156 can be received and guided on a screw 97 which can be screwed into a pocket bore hole (with self-tapped thread). This screw can likewise serve as a guide and can simultaneously serve as a stop for the outward movement of the slide 146.

The stop 160 formed by the slide 146 has a cam surface 219 which slides along on the outer edge 89 of the base plate 118 when the swivel lever is being closed. The lower edge of protuberance 160 slides along surface 89, the spring 156 being compressed. Once face 166 is reached by the lower edge of the protuberance 160, the spring forces the protuberance into contact with face 166 to effect locking.

The swivel lever locks disclosed herein can be used commercially for example in switch cabinet construction.

What is claimed is:

1. A swivel lever locking device for mounting in a thin wall including a pivoting hand lever having a closed state, a base plate having first and second projections penetrating through the wall, the first projection providing for the connection of door catching means to the hand lever, the hand lever being pivotable with respect to the base plate, the second projection having a recess for receiving a first cylinder lock, the first cylinder lock having an engaging position, a non-engaging position and a first tappet, the swivel lever locking device comprising:

a second cylinder lock which can be actuated independently of the first cylinder lock, the second cylinder lock having an engaging state, a non-engaging state and a second tappet, and, a common lever locking element, the lever locking element having a locking position, the first and second tappets acting on the common locking element to independently release the hand lever from the closed state.

2. The swivel lever locking device according to claim 1, wherein the locking element comprises a locking slide which is engaged by the first tappet when the first tappet occupies the engaging position to effect the locking position of the common locking element, and wherein the second tappet engages the locking slide when the second cylinder lock is located in the engaging state and the common locking element is located in the locking position.

3. The swivel lever locking device according to claim 2, wherein the first cylinder lock is arranged in the base plate and the second cylinder lock is arranged in the hand lever.

4. The swivel lever locking device according to claim 3, wherein the first and second cylinder locks are inserted into insertion spaces and are fastened by means of fastening screws extending transversely relative to the insertion spaces, and, wherein an elongated hole for fastening cylinder locks of different length is provided for the fastening screws in the base plate and in the hand lever.

5. The swivel lever locking device according to claim 3, wherein the locking element comprises two locking slides which are arranged at both sides of the locking cylinders and can be engaged by the tappets of the locking cylinders, and in that the two slides are rigidly connected to one another by means of a transverse connection.

6. The swivel lever locking device according to claim 5, wherein the transverse connection forms a U-section with the two locking slides, the U-section opening toward the thin wall.

7. The swivel lever locking device according to claim 1, wherein the locking element comprises a locking strip, the locking element being biased in the locking position, the first and second tappets being capable of engaging the locking strip to remove the locking element from the locking position, allowing the hand lever to pivot.

8. The swivel lever locking device according to claim 7, wherein the locking strip has a cam surface which is engaged by an engaging surface when the hand lever swivels into a near-closed position, pressure is applied to the hand lever to effect the closed position causing the cam surface to engage the engaging surface to remove the locking element from the locking position to achieve the closed position, the cam surface being released when the closed position is achieved.

9. The swivel lever locking device according to claim 1, wherein the swivel lever locking device is arranged in a fold space of a sheet metal cabinet door and the first projection being part of a lock case in which flat rods of a flat rod lock are driven and supported and from which a sash lock proceeds.

10. The swivel lever locking device according to claim 9, wherein the first cylinder lock is arranged in the base plate and the second cylinder lock is arranged in the hand lever.

11. The swivel lever locking device according to claim 10, wherein a cover is provided having a longitudinal side with at least one bulge for receiving the tappet of the second cylinder lock, a flat rod of a flat rod lock being guided along the opposite longitudinal side.

12. The swivel lever locking device according to claim 1 wherein the second projection includes a second recess for receiving the second cylinder lock.

13. The swivel lever locking device according to claim 12, wherein the second projection is enclosed by a cover.

14. The swivel lever locking device according to claim 13, wherein an edge of the cover contacts an edge surface of the thin wall surrounding the second recess to clamp the wall between the cover and the base plate.

15. The swivel lever locking device according to claim 14, wherein the cover is fastened by means of fastening screws which are screwed into the base plate.

16. The swivel lever locking device according to claim 15, wherein the fastening screws for the cover are arranged through bore holes arranged symmetrically with reference to the transverse axis of the cover so that the cover can be rearranged from left to right with reference to the base plate.

17. The swivel lever locking device according to claim 12, wherein the thin wall includes a first rectangular opening for receiving the first projection and a second rectangular opening for receiving the second projection, the first and second openings having a width (B), the first opening having a length (C) governed by the equation:

2B; and the second opening having a length (D) governed by the equation:

D=4B.

18. The swivel lever locking device according to claim 12, wherein the first and second cylinder locks are inserted into insertion spaces and are fastened by means of fastening screws extending transversely relative to the insertion spaces, and, wherein an elongated hole for fastening cylinder locks of different length is provided for the fastening screws in the base plate and in the hand lever.

19. The swivel lever locking device according to claim 18, wherein the locking element includes an axially widened window for receiving the tappets of the cylinder locks, the axial widening corresponding to the elongated hole to accommodate the tappets of cylinder locks of different lengths.

* * * * *